US005989040A

United States Patent [19]

Nishimatsu

[11] Patent Number: 5,989,040

[45] Date of Patent: Nov. 23, 1999

[54] CIRCUIT BOARD ELECTRICAL CONNECTOR

[75] Inventor: Norimasa Nishimatsu, Tokyo, Japan

[73] Assignee: Hirose Electric Co., Ltd., Tokyo, Japan

[21] Appl. No.: 09/004,342

[22] Filed: Jan. 8, 1998

[30] Foreign Application Priority Data

Jan. 8, 1997 [JP] Japan ..... 9-011841

[51] Int. Cl.[6] ..... H01R 9/09

[52] U.S. Cl. ..... 439/79; 439/680

[58] Field of Search ..... 439/79, 80, 680

[56] References Cited

U.S. PATENT DOCUMENTS 4,708,415 11/1987 White ..... 439/79

5,702,271 12/1997 Steinman ..... 439/79

5,807,126 9/1998 Bethurum ..... 439/79

*Primary Examiner*—Steven L. Stephan

*Assistant Examiner*—T C Patel

*Attorney, Agent, or Firm*—Kanesaka & Takeuchi

[57] ABSTRACT

A circuit board electrical connector (1) comprises a housing (2) with a front face having a receiving cavity (6) for receiving a mating connector (30). The housing is to be attached to a circuit board such that an opening of the receiving cavity is flush with an edge of the circuit board. A protruded bottom section (2C) is provided on a bottom of the housing and placed in a cutout section of the circuit board such that a front face of the protruded bottom section is substantially flush with the edge of the circuit board. A key groove (5) extends rearwardly from the front face of the protruded bottom section and communicates with the receiving cavity for receiving a key projection (34) of the mating connector.

2 Claims, 2 Drawing Sheets

CIRCUIT BOARD ELECTRICAL CONNECTOR

BACKGROUND OF THE INVENTION

1. Field of the Invention

The present invention relates to electrical connectors to be mounted on a circuit board such that the connector receiving opening is flush with an edge of the circuit board.

2. Description of the Related Art

Japanese patent application Kokai No. 254453/95 discloses an electrical connector of this type. FIG. 2 shows such an electrical connector 50 mounted on a circuit board P. The connector 50 has a housing 51 with a pair of flanges 52 on opposite sides attached to the circuit board P. The front face of the housing 51 is flush with an edge of the circuit board P, and a receiving cavity 53 extends rearwardly from the front face of the housing 51. The receiving cavity 53 receives a plugging section 61 of a mating connector 60 and has a rectangular shape as viewed from front. A plurality of arranging grooves 55 for contact elements 54 are provided at the center of the receiving cavity 53, and a pair of coaxial connectors 56 are provided on opposite sides of the arranging grooves. A key projection 57 is provided so as to project into the receiving cavity 53 and fit into a key groove 62 of the mating connector 60 to prevent plugging errors of the connectors.

When the connector 50 is plugged over the mating connector 60, the contact elements 54 and the coaxial connectors 56 are connected to the corresponding contact elements and coaxial connectors of the mating connector 60.

As electronic equipment becomes compact, there is a demand for compact connectors especially for low-profile connectors. In FIG. 2, the height of a connector from the circuit board is desired to be small, and the height of the receiving cavity 53 must be small.

Under such circumstances, the present of the key projection 57 puts a limit to arrangement of the contact elements. For example, no contact elements are provided on the arranging grooves 55 at an area facing the key projection 57. Thus, the space within the receiving cavity 53 is not fully utilized.

In such a conventional connector, a part of the function in the receiving cavity must be given up, or the height of the connector must be increased by that much.

SUMMARY OF THE INVENTION

Accordingly, it is an object of the invention to provide a compact circuit board electrical connector which maintains the full functions of the receiving cavity.

According to the invention there is provided a circuit board electrical connector which comprises a housing with a front face having a receiving cavity for receiving a mating connector, the housing to be attached to a circuit board such that an opening of the receiving cavity is flush with an edge of the circuit board; a protruded bottom section provided on a bottom of the housing and placed in a cutout section of the circuit board such that a front face of the protruded bottom section is substantially flush with the edge of the circuit board; and a key groove extending rearwardly from the front face of the protruded bottom section and communicating with the receiving cavity for receiving a key projection of the mating connector.

According to an embodiment of the invention, the circuit board electrical connector further comprises a metal shell attached to the housing such that it covers past at least one bottom edge of the protruded bottom section.

According to the invention, the protruded bottom section with a key groove is placed in the cutout of a circuit board so that the key groove does not increase the height of the connector. Also, the presence of the key groove in the protruded bottom section neither has any adverse effect on the receiving cavity nor decreases the housing strength.

If the housing wall is replaced by the metal shell, not only the height of the connector can further be reduced but also the protruded bottom section is reinforced to withstand forceful insertion of a key projection into the key groove.

The number, position, and/or shape of the key groove can be changed to prevent plugging errors. If the protruded bottom section is made separate from the housing so that it can be incorporated in the metal shell, it is easy to choose the desired key structure.

DESCRIPTION OF THE PREFERRED EMBODIMENT

Figure 1:
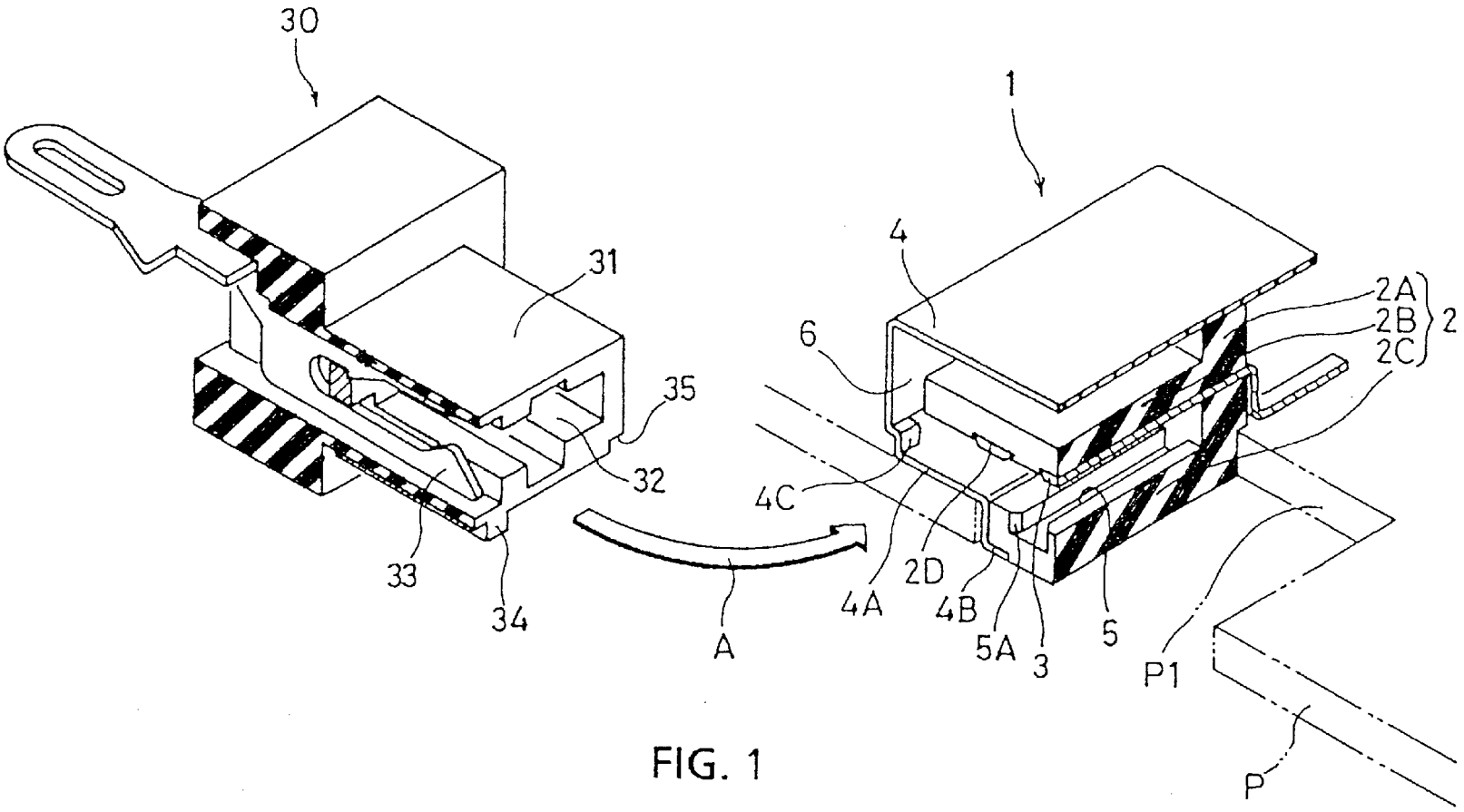
FIG. 1 is a partially cutaway perspective view of an electrical connector according to an embodiment of the invention.
Figure 2:
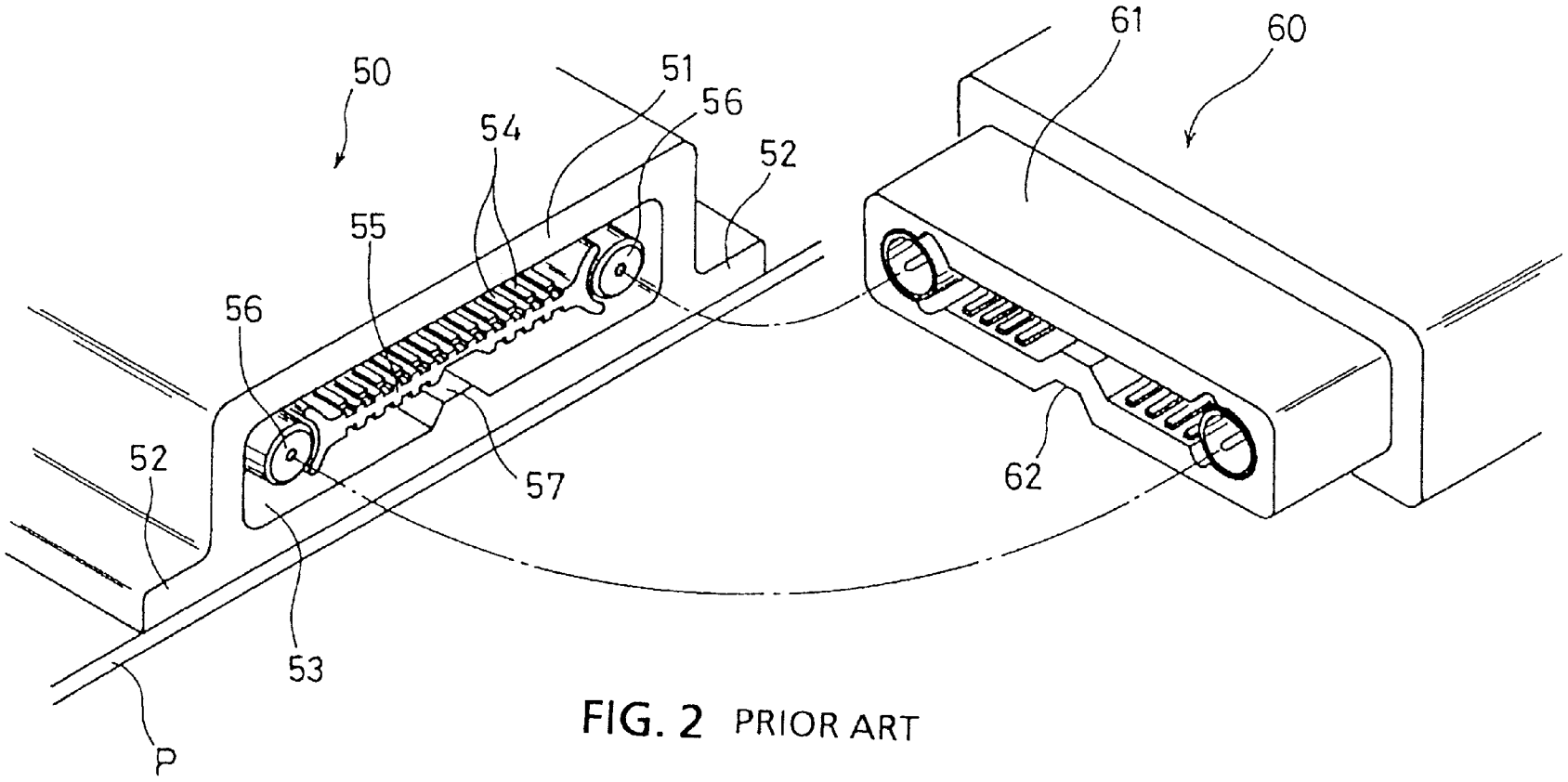
FIG. 2 PRIOR ART
FIG. 2 is a perspective view of a conventional connector.

In FIG. 1, an electrical connector 1 is plugged over a mating connector 30 as shown by an arrow A for connection.

The connector 1 includes a housing 2 made from an insulative material, a contact element 3 provided in the housing 2, and a metal shell 4 fitted over the housing 2. The housing 2 has a rear wall 2A, an arranging wall 2B extending forwardly from a middle portion of the rear wall 2A, and a protruded bottom section 2C extending forwardly from a lower portion of the rear wall 2A. A plurality of dove-tail arranging grooves 2D extend along the lower face of the arranging plate 2B. The contact portion of a contact element 3, which is made by bending a narrow flat plate in a crank shape, is inserted into the arranging groove 2D from back. The protruded bottom section 2C is provided one the bottom of the connector 1, and a key groove 5 extends rearwardly from the front face of the protruded bottom section 2C. The front face of the protruded bottom section 2C is substantially flush with the front face of the arranging groove 2D. The opening of the key groove 5 is tapered to provide a guiding portion 5A.

The metal shell 4 made by bending a metal plate is fitted over the housing 2 to cover the top of the rear wall 2A, the sides of the arranging plate 2B, and the sides and the bottom edges of the protruded bottom section 2C. The inside space defined by the metal shell 4 provides a receiving cavity 6 for receiving the plugging portion 31 of a mating connector 30.

The metal shell 4 has an attaching bottom section 4A at a level substantially flush with the top face of the protruded bottom section 2C and an L-shaped section which extends downwardly from the attaching bottom section 4A and engages the entire length of the edge of the protruded bottom section 2C. An auxiliary key projection 4C is provided at a bottom corner of the metal shell 4 so as to project inside for preventing plugging errors.

The connector 1 is attached to a circuit board P such that the protruded bottom section 2C and the L-shaped section 4B of the metal shell 4 are placed in a cutout section P1 of the circuit board P. Then, the connection portion of the contact element 3, which projects rearwardly from the rear wall 2A of the housing 2, is soldered to a predetermined trace of the circuit board P.

The mating connector 30 has a plugging section 31 projecting forwardly from the housing. A female contact element 33 is provided in an inside cavity 32 of the plugging section 31. When the plugging section 31 is received in the receiving cavity 6 of the connector 1, the inside cavity 32 defines a space for receiving the arranging plate 2B. A key projection 34 extends in a plugging direction along the bottom of the plugging section 31. An auxiliary key groove 35 is provided at a bottom edge of the plugging section 31.

The key groove 5 of the connector 1 and the corresponding key projection 34 of the mating connector 30 may be provided in given numbers at given positions in the widthwise direction of the connectors. By changing the number and/or position according to the type of connectors, it is possible to prevent plugging of different types of connectors. The auxiliary key projection 4C of the connector 1 and the auxiliary key groove 35 of the mating connector 30 prevent plugging errors between the right connectors without main keys.

When the mating connector 30 is plugged into the connector 1 in the direction A, the key projection 34 and the key groove 5 prevent wrong connectors from being plugged in, and the auxiliary key groove 35 and the auxiliary key projection 4C prevent right connectors from being plugged-in in a wrong direction.

Alternatively, the metal shell in FIG. 1 may be replaced by a wall of the housing.

If the protruded bottom section with the key groove is made separate from the housing, it is not only possible to select a proper protruded bottom section with key grooves of a different number and positions to meet different conditions but also it is sufficient to provide only a single type of metal mold for making the common housing.

As has been described above, according to the invention, a key groove is made in the protruded bottom section of a housing, which is placed in the cutout section of a circuit board, so that not only the height of the connector is not increased by the key groove but also the space for the connector functions is not blocked by the key groove. If the protruded bottom section is made separate from the housing, it is not only easy to change the key groove but also sufficient to provide a single type of metal mold for making the common housing.

What is claimed is:

1. A circuit board electrical connector comprising:

a housing with a front face having a receiving cavity for receiving a mating connector, said housing being attached to a circuit board such that an opening of said receiving cavity is flush with an edge of said circuit board;

a protruded bottom section provided on a bottom of said housing and placed in a cutout section of said circuit board such that a front face of said protruded bottom section is substantially flush with said edge of said circuit board;

a key groove provided on an upper face of said protruded bottom section and extending rearwardly from said front face of said protruded bottom section and communicating with said receiving cavity for receiving a key projection of said mating connector, thus minimizing the height of said connector and preventing plugging error of different connectors; and a metal shell attached to said housing such that it covers a top of a rear wall, sides of an intermediate plate, and sides and bottom edges of said protruded bottom section to define said cavity of said housing, wherein said metal shell has an attaching bottom section at a level substantially flush with the top face of said protruded bottom section and an L-shaped section which extends downwardly from said attaching bottom section and engages the entire length of said edge of said protruded bottom section, thus further reducing the height of said connector and reinforcing said protruded bottom section.

2. A circuit board electrical connector according to claim 1, wherein said metal shell comprises an auxiliary key projection provided at a bottom corner thereof and projecting inside.

* * * * *